United States Patent [19]

Morii et al.

[11] Patent Number: 5,074,230

[45] Date of Patent: Dec. 24, 1991

[54] WORKPIECE FABRIC HOLDING DEVICE FOR USE IN SEWING MACHINE

[75] Inventors: Satoshi Morii; Kunihiko Murata, both of Nagoya; Hiroyuki Mitsui, Kasugai; Toshiaki Iwasaki, Nagoya, all of Japan

[73] Assignee: Brother Kogyo Kabushiki Kaisha, Japan

[21] Appl. No.: 583,998

[22] Filed: Sep. 18, 1990

[30] Foreign Application Priority Data

Oct. 27, 1989 [JP] Japan ..... 1-280848

[51] Int. Cl.[5] ..... D05B 21/00

[52] U.S. Cl. ..... 112/121.15; 112/121.14; 112/114; 223/38

[58] Field of Search ..... 112/121.15, 121.12, 112/265.1, 262.3, 114, 103, 102, 104, 113, 311, 121.11, 121.14; 223/38

[56] References Cited

U.S. PATENT DOCUMENTS

| | | | |
|---|---|---|---|
| 3,749,038 | 7/1973 | Dodsworth | 112/121.15 |
| 4,445,631 | 5/1984 | Olivares | 112/121.15 X |
| 4,463,697 | 8/1984 | Vogt et al. | 112/121.15 X |
| 4,493,276 | 1/1985 | Sadeh | 112/121.12 |
| 4,574,717 | 3/1986 | Jünemann et al. | 112/121.12 |
| 4,587,910 | 5/1986 | Raines | 112/121.15 X |
| 4,719,863 | 1/1988 | Bisson | 112/121.12 |
| 4,821,659 | 4/1989 | Morii et al. | 112/121.15 |
| 4,883,006 | 11/1989 | Marii et al. | 112/121.12 |
| 5,014,633 | 5/1991 | Murata et al. | 112/121.12 |

*Primary Examiner*—Werner H. Schroeder
*Assistant Examiner*—Paul C. Lewis
*Attorney, Agent, or Firm*—Oliff & Berridge

[57] ABSTRACT

A workpiece fabric holding or clamping device having a lower plate for holding a major part of the workpiece and a plurality of upper plates movable in a horizontal direction above the lower plate for selectively holding the workpiece in combination with the lower plate. The lower plate is formed with an opening whose area covers at least two sewing loci, and the upper plates are each respectively formed with needle slits having two sides. Each side is provided with downwardly extending fabric clamping portions extending into the opening of the lower plate. Through horizontal movements of the plurality of upper plates, at least two sewing loci are defined by the combination of the needle slits. If the slits are positioned spaced away from each other, an auxiliary pressure plate is positioned in the space to hold the spaced portion of the workpiece. Further, the upper plates are vertically movable. The horizontal movements of the upper plates are performed at ascent positions of the upper plates. In the ascent positions, the upper plates are spaced away from the workpiece while the lower plate continuously holds the workpiece in place.

9 Claims, 9 Drawing Sheets

WORKPIECE FABRIC HOLDING DEVICE FOR USE IN SEWING MACHINE

BACKGROUND OF THE INVENTION

The present invention relates to a workpiece fabric holding device. The present invention also relates to a pocket setter having a workpiece fabric holding device.

An automatic pocket setter unit has been proposed in U.S. Pat. No. 4,883,006 for automatically sewing a pocket to a garment. In this unit, edge portions of a pocket cloth are folded by a pocket folding means, and the folded edge portions are stitched to the garment.

More specifically, as shown in FIG. 10, the pocket setter unit includes a sewing machine 101 for performing a stitching operation, a sewing machine table 102, a work-piece fabric holding/feeding unit 103 for pressedly holding a workpiece or a pocket cloth W onto the sewing machine table 102, a pocket folder 104 for folding edge portions of the pocket cloth W and for mounting the pocket cloth onto a garment, and a stacker 105 for successively stacking stitched pocket cloths and the garments. The sewing machine table 102 serves as a working table available for both the pocket folder 104 and the sewing machine 101 as well as for a throat plate therefor.

The sewing machine 101 described is movable in the Y-direction by a moving mechanism which includes a Y-axis servo motor (not shown in FIG. 10) and a toothed belt 112. The workpiece fabric holding/feeding unit 103 includes a pressure plate 114 formed with a slit-like needle cut-out 113, and a feed arm 115 to which the pressure plate 114 is attached. A second moving mechanism is provided for moving the feed arm 115 in X-direction. The second moving mechanism includes an X-axis servo motor 116 and a toothed belt 117. Further, the feed arm 115 is supported on a slider member 118 movable in a vertical direction. The slider member 118 is connected to a pneumatic cylinder 119 whose cylinder rod is vertically extendible and retractable, so that the feed arm 115 is movable in a vertical direction. Consequently, the pressure plate 114 has a descent position in which the plate 114 is pressingly positioned on the sewing machine table 102, and an ascent position in which the plate 114 is moved away from the sewing machine table 102.

The pocket cloth whose edges are folded by the pocket folder 104 is mounted on the garment mounted on the sewing machine table 102. Then, the pocket folder 104 is moved upwardly, and the workpiece holding/feeding unit 103 is moved so as to press the workpieces W (including the pocket cloth and the garment) onto the sewing machine table 102 by the pressure plate 114. Thereafter, the workpiece holding/feeding unit 103 moves, the workpieces W slidingly on table 102 from a pocket folder position to the sewing machine position. By controlling the movements of the sewing machine 101 and the workpiece fabric holding/feeding unit 103, a sewing locus for performing a pocket stitching is provided along the needle cut-out 113 formed on the pressure plate 114 for performing a pocket stitching.

In this type of automatic sewing machine, the workpieces W including the pocket cloth and the garment are stackedly pressed on the sewing machine table 102, and the workpiece fabric holding/feeding unit 103 moves the work-pieces W to the intended needle location for moving the workpieces W along the sewing locus. As described in the above U.S. Pat. No. 4,883,006, the workpiece fabric holding/feeding unit 103 is provided with the pressure plate 114. A thin needle slot or cut-out is formed in the pressure plate 114. The thin needle slot or cut-out has a configuration in conformance with the sewing locus.

In this case, if the sewing locus is of a single array, the above described pressure plate 114 is available for performing its inherent function. However, if sewing must be made along two arrays of sewing loci 3 and 4 as shown in FIG. 9, it would be almost impossible to press a portion adjacent the sewing loci 3 and 4 with using the pressure plate 114 formed by the simple needle slot 113.

In this connection. U.S. Pat. No. 3,930,454 discloses a workpiece fabric holding device capable of performing two arrayed sewing. According to the disclosed device, three pieces of movable plates are prepared for pressing an inner side of a pocket cloth 2, and these movable plates are moved by pneumatic cylinders. In case of sewing along an outer sewing locus 3, the movable plate is positioned in a vicinity of an edge portion of a stationary plate for pressing the outer side of the pocket cloth 2, so that a thin needle slot corresponding to the outer sewing locus 3 is formed. In case of sewing along an inner sewing locus 4, the movable plates are retracted so as to form a wide needle slot, and the movable plates press inner side of the inner sewing locus 4.

However, in the above described conventional device, when sewing along the inner sewing locus 4, a large distance is provided between the movable plates and the stationary plate, and the stationary plate presses a portion of workpiece W spaced away from the inner sewing locus 4. On the other hand, when sewing along the outer sewing locus 3, the three pieces of the movable plates are outwardly projected, so that gaps are provided between the neighboring movable plates. The gap portion cannot press against the pocket cloth portion which is the inner side portion with respect to the outer sewing locus 3.

Therefore, the conventional device may be only available for sewing a thick cloth such as jeans, but the device does not appear to be available for sewing a thin cloth. That is, n the latter case, the thin workpiece fabric may become jumped or corrugated in response to every penetration of the sewing needle therethrough, and a hook of a shuttle race body may fail to catch the thread, to thereby causing skip stitches and thread breakage.

Further, according to the conventional device, the movable plates are moved while maintaining pressure to the workpiece fabrics i.e., a garment 1 and the pocket cloth 2. Therefore, the garment 1 and the pocket cloth 2 may be displaced relative to each other. Specifically, regarding the thin cloth, the folded edge portion of the pocket cloth 2 may become displaced or deviated during the movements of the movable plates. To avoid these drawbacks, the bottom surfaces of the movable plates are not provided with elastic members such as sponges, but their bare metal surfaces are exposed to reduce sliding resistance with respect to the workpiece fabrics 1 and 2. Still however, the workpiece holding performance may still be degraded, if the entire workpiece fabrics 1 and 2 are slidably moved on the sewing machine table 102 by the workpiece fabric holding device, because the relative displacement between the garment 1 and the pocket cloth 2 may occur at the pressing portions given by the movable plates.

In another conventional workpiece fabric holding device, the entire device is lifted together with the stationary plate so as to move the movable plates. With this structure, a negative pressure suction means is be required to avoid displacement of the workpiece fabrics on the sewing machine table during the lifting of the holding device. Consequently, the resultant device becomes much more intricate and costly.

SUMMARY OF THE INVENTION

Therefore, it is an object of the present invention to overcome the above described prior art drawbacks and disadvantages, and to provide an improved workpiece fabric holding device capable of avoiding skip stitches or thread breakage with respect to sewing on thin workpieces, and capable of performing sewing along a plurality of arrays of sewing loci.

Another object of this invention is to provide a workpiece fabric holding device in which relative positional displacement between a garment and a cloth stacked thereon such as a pocket cloth can be obviated.

These and other objects of the present invention will be attained by providing a workpiece fabric holding device for holding a workpiece and relatively moving the workpiece to a needle location while continuing to hold to the workpiece, comprising a lower plate movably supported for pressing the workpiece, and formed with an opening through which sewing portions including at least two sewing loci are exposed, the lower plate having a lower surface in contact with the workpiece, at least two upper plates movable supported in a horizontal direction on the lower plate, the upper plates provided with fabric clamping portions protrudable into the opening and having lower surfaces, needle slits formed at the fabric clamping portions to allow a sewing needle to pass therethrough, the needle slits having a configuration corresponding to the sewing loci, the lower surfaces of the fabric clamping portions positioned flush with the lower surface of the lower plate when the fabric clamping portions clamp the workpiece, and horizontal motion driving means for moving the upper plates to first and second positions in the horizontal direction, such that one of the sewing loci provided in combination with the needle slits when the upper plates are moved to the first horizontal positions and another sewing locus being provided when the upper plates are moved to the second horizontal positions.

In another aspect of the present invention, a workpiece fabric holding device for holding a workpiece is provided for relatively moving the workpiece to a needle location while continually holding the workpiece, comprising a lower plate movably supported for pressing the workpiece, and formed with an opening through which sewing portions including at least two sewing loci are exposed, the lower plate having a lower surface in contact with the workpiece, at least two upper plates movably supported in a horizontal direction on the lower plate, the upper plates provided with fabric clamping portions protrudable into the opening and having lower surfaces, needle slits formed by the fabric clamping portions to allow a sewing needle to pass therethrough, the needle slits having a configuration corresponding to the sewing loci and the lower surfaces of the fabric clamping portions positioned flush with the lower surface of the lower plate when the fabric clamping portions clamp the workpiece, the upper plates movable in a vertical direction as well as in the horizontal direction for providing ascent positions and descent positions, the lower surfaces of the fabric clamping portions being flush with the lower surface of the lower plate when the upper plates are in their descent positions, whereby the workpiece is held by the lower plate and the fabric clamping portions at positions adjacent the needle location, horizontal motion driving means for moving the upper plates to first and second positions in the horizontal direction, one of the sewing loci defined by the combination with the needle slits when the upper plates are moved to the first horizontal positions and another sewing locus defined when the upper plates are moved to the second horizontal positions, a vertical motion driving means for moving the upper plates in a vertical direction, the vertical motion driving means supported on the lower plate and connected to the upper plates, the horizontal motion driving means being driven during a state in which the upper plates are in their ascent are position spaced away from the workpiece, an auxiliary pressure plate movably positioned above the lower plate, the auxiliary pressure plate having an operative position protrudable into the opening and a non-operative position retracted therefrom, and means for moving the auxiliary pressure plate between the operative and non-operative positions, the auxiliary pressure plate pressing a part of the workpiece at its operative position for ensuring the holding of a workpiece portion which is not being held by the fabric clamping portions.

BRIEF DESCRIPTION OF THE DRAWINGS

In the drawings:

FIG. 5(*b*) is a cross-sectional view taken along a line V—V of FIG. 2;

DETAILED DESCRIPTION OF THE PREFERRED EMBODIMENT

A workpiece fabric holding device according to one embodiment of this invention will now be described with reference to the drawings.

Figure 1:
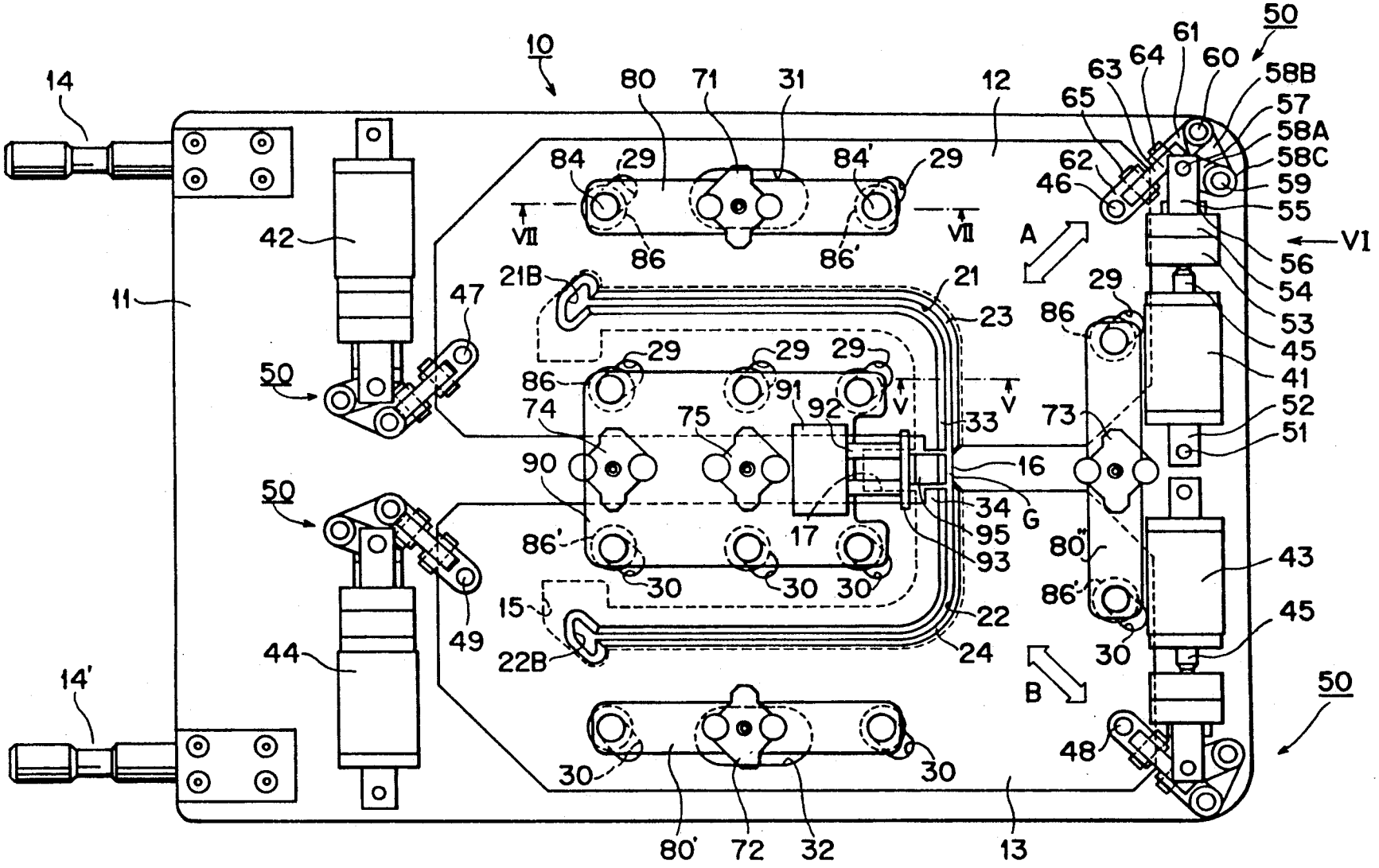
FIG. 1 is a plan view showing a workpiece fabric holding device according to one embodiment of this invention and showing a state when sewing along an outer sewing locus.
Figure 2:
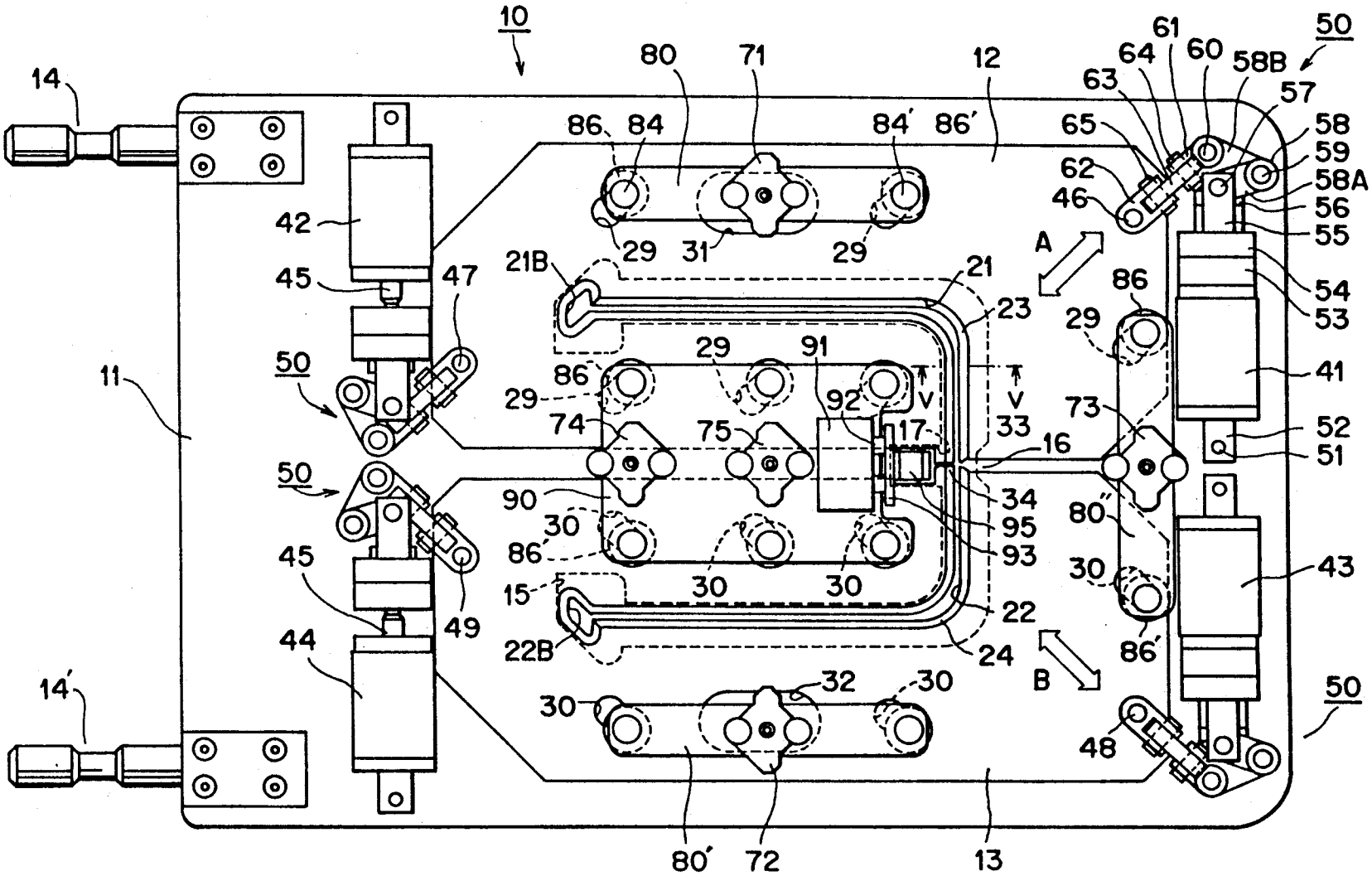
FIG. 2 is a plan view showing a workpiece fabric holding device according to one embodiment of this invention and showing another state when sewing along an inner sewing locus.
Figure 9:
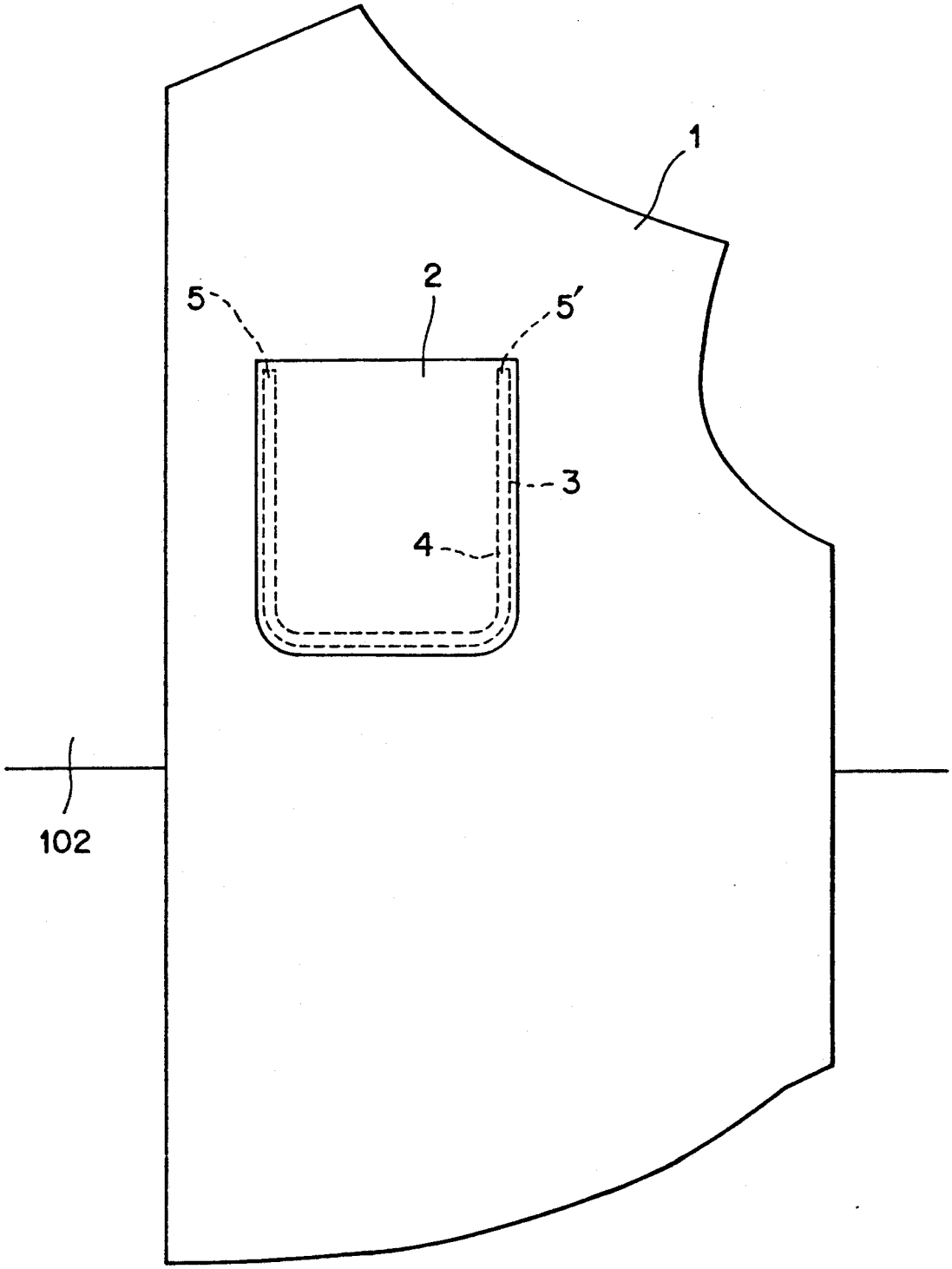
FIG. 9 is a plan view showing workpiece fabrics such as a garment, and a pocket cloth.
Figure 10:
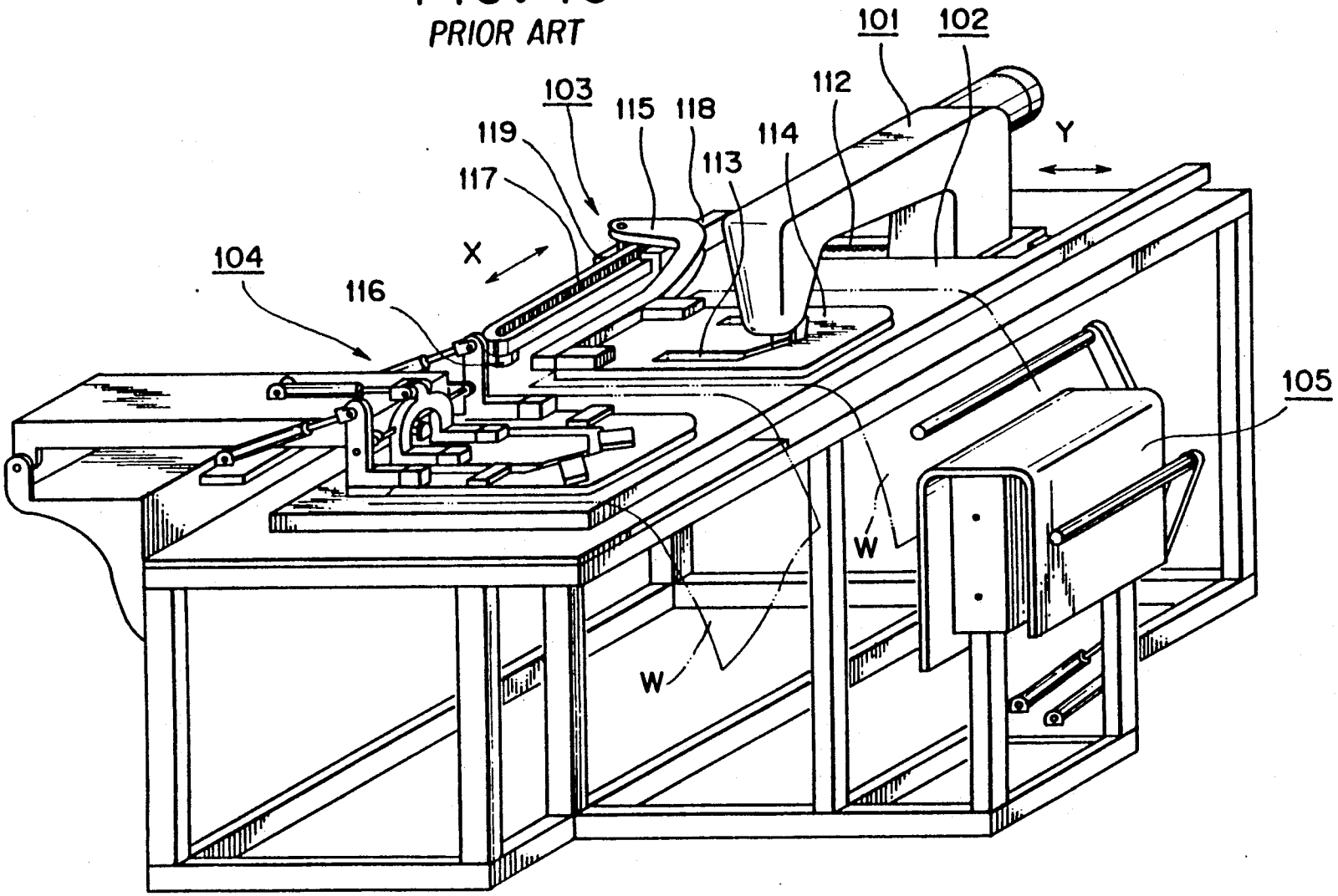
FIG. 10 PRIOR ART
FIG. 10 is a schematic perspective view showing a general arrangement of a prior art pocket setter.

The workpiece fabric holding device 10 corresponds to a pressure plate 114 of a pocket setter as shown in FIG. 10. That is, instead of the pressure plate 114, the holding device 10 is attached to a feed arm 115 which is movable in the X-direction and the vertical direction. The workpiece fabric holding device 10 is adapted to perform sewings along a plurality of arrays of sewing loci. More specifically, as shown in FIG. 9, the holding device 10 pressingly holds workpieces including a garment 1 and a pocket cloth 2 onto a sewing machine table 102 when the workpieces 1 and 2 are subjected to sewing along two arrays of the sewing loci 3 and 4. FIG. 1 shows one state of the holding device 10 when sewing the workpieces along the outer sewing locus 3, and FIG. 2 shows another state of the holding device 10 when sewing the workpieces along the inner sewing locus 4.

The workpiece fabric holding device 10 primarily includes a lower plate 11 and a pair of upper plates 12 and 13. The lower plate 11 is adapted to press the major area portions of the garment 1 and the pocket cloth 2 onto the sewing machine table 102, and the two upper plates 12 and 13 are adapted to press a workpiece portion adjacent to a needle location, i.e., the sewing loci 3 and 4.

Figure 3:
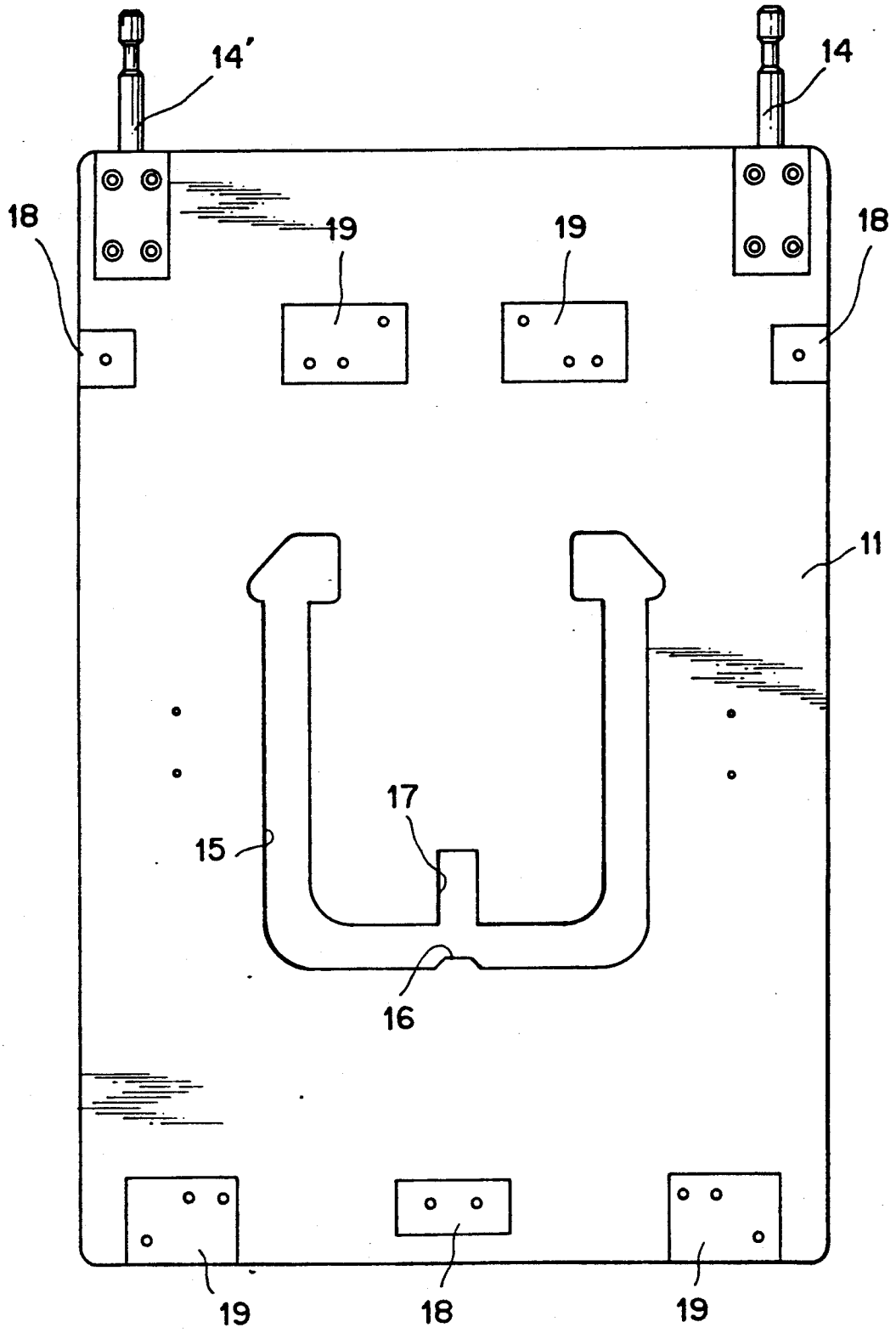
FIG. 3 is a plan view showing a lower plate which is one of the essential elements of the workpiece fabric holding device according to the embodiment of this invention.

The lower plate 11 is best shown in FIG. 3. The lower plate 11 has a rectangular configuration and is formed of stainless steel. One side end portion of the lower plate 11 is fixed with jigs 14 and 14', which are detachably coupled to the feed arm 115 shown in FIG. 10. As is apparent from a description in the "Background of the Invention" section, the feed arm 115 is adapted for lifting the workpiece fabric holding device 10 from the sewing machine table 102 so as to allow the workpieces to be installed on the table 102 and below the holding device 10, Further, the feed arm 115 moves the workpiece fabric holding device 10 downwardly so as to pressingly hold the workpieces onto the sewing machine table 102 and to horizontally and slidingly move the workpieces 1 and 2 relative to the table 102. The lower plate 11 has a central portion formed with a generally U-shaped opening 15 for exposing sewing loci portions 3 and 4 of the workpieces 1 and 2. The configuration of the opening 15 is in conformance with an edge contour of the pocket cloth 2. At a bottom portion of the U-shaped opening 15, an extension portion 16 protrudes into the opening space, and at a position in confrontation with the extension portion 16, a notched portion 17 is formed which extends in parallel with arm portions of the U-shaped opening 15. The extension portion 16 and the notched portion 17 are formed in association with an auxiliary pressure plate 95 (FIG. 8) described later. Further, seats 18 and 19 are provided on the lower plate 11 for fixing pneumatic cylinders 41 through 44 and a link mechanism 50 also described later.

Figure 4:
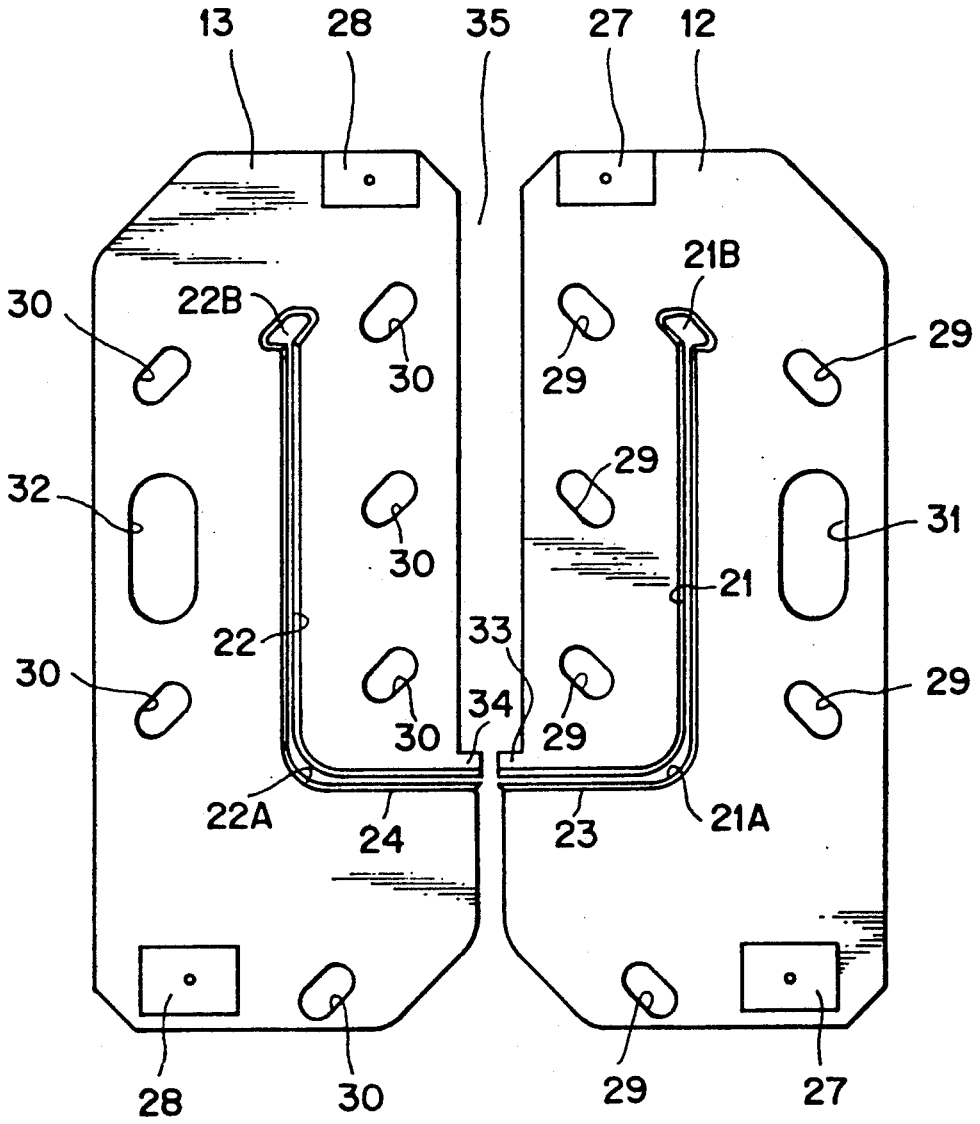
FIG. 4 is a plan view showing the right and left upper plates which are essential components of the workpiece fabric holding device according to the embodiment.

On the other hand, as shown in FIG. 4, the pair of upper plates 12 and 13 are symmetrically arranged and are formed of stainless steel. The upper plates 12 and 13 are formed with a generally L-shaped slits 21 and 22. The combination of the two L-shaped slits 21 and 22 corresponds to the configuration of the one of the sewing loci 3 and 4. Each ends of the horizontally extending portions of the L-shaped slits 21 and 22 is opened to each of the side edges of the upper plates 12 and 13 as shown, the opened position corresponding to a center portion of a bottom edge portion of the pocket cloth 2. The open end portions of the L-shaped slits 21 and 22 define abuttable portions 33 and 34. Each of the linear portions of the slits 21 and 22 has a narrow width so as to allow the sewing needle to pass therethrough. Further, each of the corner portions 21A and 22A has a relatively enlarged width. Moreover, each of the upper portions 21B and 22B of the slits 21 and 22 corresponding to the upper side edge portion of the pocket cloth 2, has an enlarged area of rhombic shape.

Figure 5A:
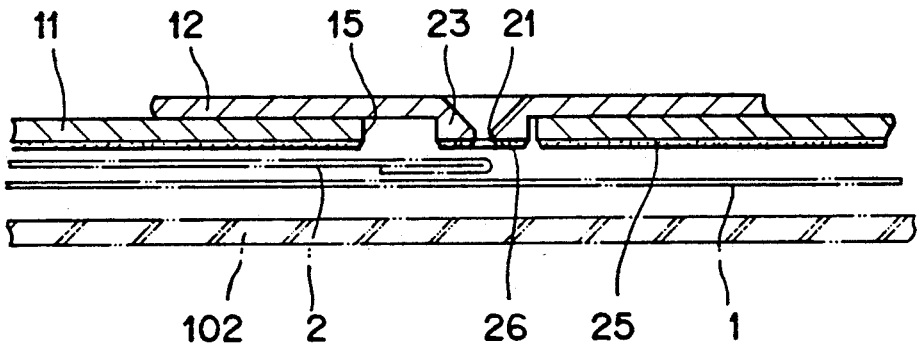
FIG. 5(*a*) is a cross-sectional view taken along a line V—V of FIG. 1.
Figure 5B:
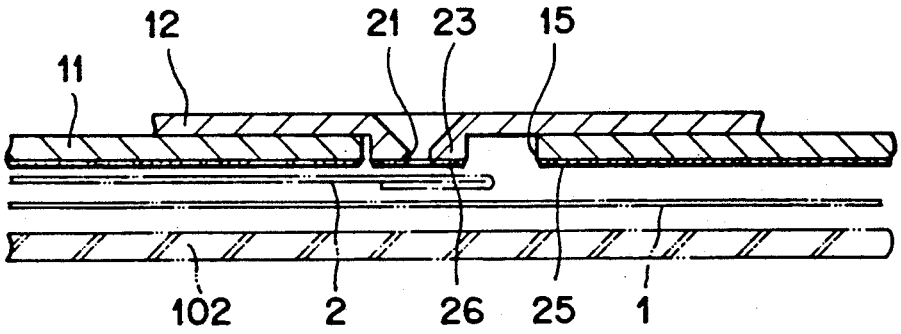

FIGS. 5(*a*) and 5(*b*) are cross-sectional views taken along the lines V—V of FIG. 1 and V—V of FIG. 2, respectively. To better understand to the structure, the sewing machine table 102 and the workpiece fabrics 1 and 2 are spaced away from each other as shown by imaginary lines. In reality, the garment 1 and the pocket cloth 2 are in intimate contact with each other on the table 102, since the lower plate 11 presses the upper surfaces of the workpiece fabrics 1 and 2 toward the table 102.

The portions surrounding the slots 21, 22 of the upper plates 12, 13 have large thicknesses extending downwardly to provide fabric clamping portions 23 and 24. The extending length of the fabric clamping portions 23, 24 is equal to a thickness of the lower plate 11. Therefore, when the lower surfaces of the upper plates 12 and 13 are in intimate contact with the upper surface of the lower plate 11, the fabric clamping portions 23, 24 of the upper plates 12, 13 are protruded into the U-shaped opening 15 of the lower plate 11, and the lower surface of the lower plate 11 is flush with the lower surfaces of the fabric clamping portions 23, 24. Further, the lower surface of the lower plate 11 and the lower surfaces of the fabric clamping portions 23, 24 of the upper plates 12, 13 are attached with elastic members 25, 26 such as sponge-like rubber pieces, so as to provide sufficient holding to the workpieces 1, 2 on the sewing machine table 102.

Turning back to FIG. 4, the upper plates 12, 13 are provided with seats 27, 28, respectively for installing the link mechanism 50 described later. The upper plates 12, 13 are formed with a plurality of elongated slots 29, 30 slantingly extending with respect to a major length direction of the rectangular upper plates. Further, the upper plates 12, 13 are formed with oblong slots 31, 32 extending in parallel with the major length direction thereof. Furthermore, the confronting sides of the upper plates 12 and 13 are formed with cut away portions except for confronting end portions or the mutually abuttable portions 33 and 34 of the needle slits 21 and 22, so that when the abuttable portions 33 and 34 are brought into abutment with each other, a linear opening 35 is provided which is alignable with the notched portion 17 of the lower plate 11.

As shown in FIG. 1 and as described above, the fabric clamping portions 23 and 24 of the left and right upper plates 12 and 13 protrude into the U-shaped opening 15 of the lower plate 11 when the lower surfaces of the upper plates 12 and 13 are brought into intimate contact with the upper surface of the lower plate 11. The width of the U-shaped opening 15 is larger than the widths of the fabric clamping portions 23 and 24, so that the two upper plates 12 and 13 can be horizontally movable within the range of difference in width. In the illustrated embodiment, the two upper plates 12 and 13 are diagonally movable in the directions indicated by arrows A and B, relative to the lower plate 11, and further, the upper plates 12 and 13 are also movable in a vertical direction.

Next to be described is a horizontal motion driving means for moving the upper plates 12 and 13 in the horizontal direction with reference to FIGS. 1. 4 and 6. The horizontal motion driving means generally includes pneumatic cylinders 41 through 44 and the link mechanisms 50. More specifically, the pneumatic cylinders 41 and 42 are drivingly connected to the upper plate 12, and the pneumatic cylinders 43 and 44 are drivingly connected to the other upper plate 13 so as to move the upper plates 12 and 13 in the horizontal direction. Vertical pins 46 and 47 are inserted in the upper plate 12 at a relatively diagonal position thereto, and vertical pins 48 and 49 are inserted in the other upper plate 13 at a relatively diagonal position thereto. The cylinder rods 45 of the pneumatic cylinders 41 through 44 are connected to an associated vertical pin 46 through 49 via one of the link mechanisms 50. In accordance with extension and retractions of the cylinder rods 45, the upper plates 12 and 13 are horizontally and diagonally moved, along the elongated slots 29 and 30 (FIG. 4), namely, in the directions A and an B.

Figure 6:
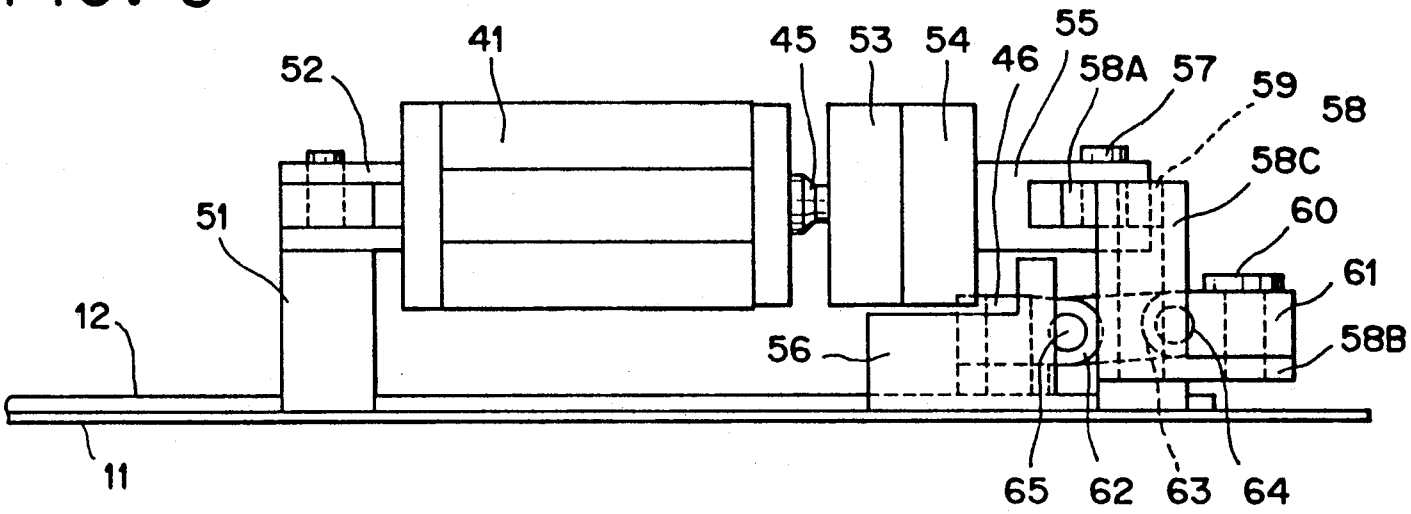
FIG. 6 is a side elevational view as viewed from an arrow VI of FIG. 1.

FIG. 6 shows one pneumatic cylinder 41 and associated one link mechanisms 50 as viewed from a direction VI of FIG. 1. A vertical post 51 extends from the lower plate 11, and a bifurcated joint portion 52 provided at a rear portion of the pneumatic cylinder 41 is pivotally connected to the vertical post 51. Therefore, the pneumatic cylinder 41 is pivotable about the vertical post 51 in the horizontal plane. The cylinder rod 45 of the pneumatic cylinder 41 has two stop collars 53 and 54 and a bifurcated joint 55. The stop collars 53 and 54 are adapted for adjusting a stroke of the pneumatic cylinder 41. The rear stop collar 53 is abuttable against a front face of the pneumatic cylinder 41 so as to regulate a retracted position of the cylinder rod 45, whereas the front stop collar 54 is abuttable against a stop block 56 fixed to the lower plate 11, so as to regulate the most advanced position of the cylinder rod 45. Further, the bifurcated joint 55 attached to a tip end portion of the cylinder rod 45 is pivotally connected to a stepped swing lever 58 through a vertically extending linking pin 57.

The stepped swing lever 58 includes a vertically extending sleeve portion 58C rotatably supported by a shaft 59 extending from the lower plate 11, an upper arm 58A extending from an upper portion of the sleeve portion 58C in a horizontal plane, and a lower arm 58B extending from a lower portion of the sleeve portion 58C in a horizontal plane. The upper and lower arms 58A and 58B are intersect with each other at an angle of 45 degrees, as best shown in FIG. 1. The upper arm 58A of the stepped swing lever 58 is connected to the bifurcated joint 55 of the cylinder rod 45 through the linking pin 57. On the other hand, the lower arm 58B is connected to a floating second bifurcated joint 61 through a stepped shaft 60, and the floating bifurcated joint 61 is connected to a third bifurcated joint 62. More, specifically, vertical pin 46 extends vertically from the upper plate 12, and the third bifurcated joint 62 is supported rotatably about the pin 46, so that the joint 62 is angularly rotatable in a horizontal plane. The second and third bifurcated joints 61 and 62 are connected together by a joint plate 63 and are rotatably coupled thereto by horizontally extending pins 64 and 65. In this connection, the joint plate 63 is angularly movable in a vertical plane.

With this arrangement of the horizontal motion drive means, when the cylinder rod 45 of the pneumatic cylinder 41 is extended or retracted, the stepped swing lever 58 is pivotally moved in a horizontal plane about the shaft 59, which extends from the lower plate 11. In accordance with the swinging movement of the lower arm 58B, the upper plate 12 is moved in the diagonal direction A in a horizontal plane. The connection between the second and third bifurcated joints 61 and 62 by way of the joint plate 63 allows vertical movement of the upper plate 12. It should be noted that other three pneumatic cylinders 42, 43 and 44 and associated link mechanisms 50 have structures the same as those described above.

Next, a vertical motion driving means will be described for moving the upper plates 12 and 13 in the vertical direction with reference to FIGS. 1 and 7. The vertical motion driving means generally includes five pneumatic cylinders 71 through 75, linking plates 80, 80', 80'' and a central linking plate 90.

Figure 7:
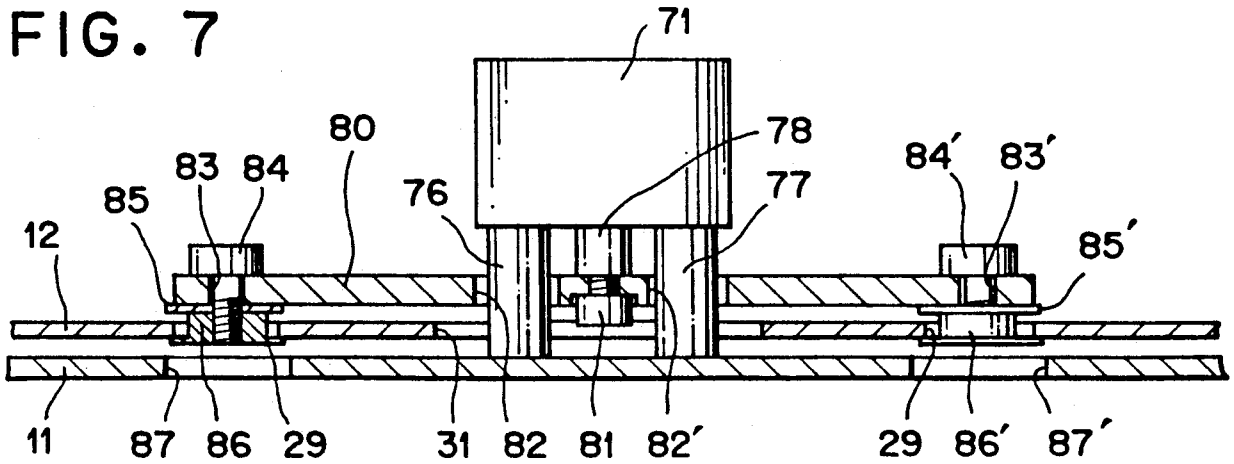
FIG. 7 is a cross-sectional view taken along a line VII—VII of FIG. 1.

As shown in FIGS. 1 and 7, the upper plates 12 and 13 are movable in the vertical direction by five pneumatic cylinders 71 through 75 provided on the lower plate 11. More specifically, as best shown in FIG. 7, hollow cylindrical spacers 76 and 77 vertically extend from the lower plate 11. The two spacers 76 and 77 extend through the oblong slot 31 (FIG. 4) to fixedly support a front face of the pneumatic cylinder 71. A cylinder rod 78 of the pneumatic cylinder 71 extends downwardly, and performs vertical extension and retraction. A tip end portion of the cylinder rod 78 is fixed to a narrow rectangular shaped linking plate 80 extending in a horizontal direction by means of a screw 81. Therefore, the linking plate 80 is movable in a vertical direction together with the cylinder rod 78. The linking plate 80 is formed with holes 82 and 82' through which the spacers 76 and 77 extend. Further, the linking plate 80 has longitudinal end portions formed with bores 83, 83' through which threaded bolts 84 and 84' extend. The threaded bolts 84, 84' engage washers 85, 85' and threadingly engage a flanged collars 86, 86'. Therefore, the flanged collars 86, 86' are provided integrally with the linking plate 80. The flanged collars 86, 86' are engageable with the diagonally extending elongated slots 29 (FIG. 4) formed in the upper plate 12. Therefore, the flanged portions of the flanged collars 86, 86' define a vertical position of the upper plate 12 in response to the vertical motion of the cylinder rod 78. Moreover, the lower plate 11 is formed with enlarged holes 87, 87' for preventing the flanged collars 86, 86' from mechanically interfering with the lower plate 11 when the linking plate 80 is moved downwardly.

When the cylinder rod 78 of the pneumatic cylinder 71 is downwardly extended, the linking plate 80 is moved to its descent position, where the upper plate 12 is urged onto the upper surface of the lower plate 11 because of the urging force of the cylinder 71. This is the descent position of the upper plate 12. On the other hand, when the cylinder rod 78 of the pneumatic cylinder 71 is upwardly retracted, the linking plate 80 is moved to its ascent position, so that the upper plate 12 is also moved upwardly because of the engagement between the flanged collars 86, 86' and the diagonal slots 29. This is the ascent position of the upper plate 12. It should be noted that since the flanged collars 86, 86' continuously engage the diagonal slots 29, a upper plate 12 is movable in the horizontal direction along the extension of the diagonal slots 29, regardless of the ascent or descent position thereof.

Among the five pneumatic cylinders 71 through 75, three pneumatic cylinders 71, 72 and 73 have respective linking plates 80, 80' and 80" as best shown in FIG. 1, and the structures of the cylinders 72, 73 and the linking plates 80', 80" are the same as those shown in FIG. 7. However, the linking plate 80 supports only the upper plate 12, the linking plate 80' supports only the upper plate 13, while linking plate 80" supports the both upper plates 12 and 13. On the other hand, the remaining two pneumatic cylinders 74 and 75 are positioned at a central portion of the lower plate 11.

More specifically, spacers for supporting the pneumatic cylinders 74 and 75 extend from the lower plate 11 and at a space defined between the upper plates 12 and 13. Piston rods of the pneumatic cylinders 74 and 75 are connected to a single central linking plate 90. The central linking plate 90 has side end portions each being provided with three washers 85, 85' and three flanged collars 86, 86'. The six flanged collars 86, 86' are engageable with the diagonal slots 29 and 30 formed in the inner side of the left and right upper plates 12 and 13. Consequently, the central linking plate 90 is driven by two pneumatic cylinders 74 and 75 in order to vertically move both the left and right upper plates 12 and 13.

Upon simultaneous actuations of the five pneumatic cylinders 71 through 75 to extend the cylinder rods 78, the left and right upper plates 12 and 13 are moved to their descent positions, and upon simultaneous retraction of the cylinder rods 78, these upper plates are moved to their ascent positions. In the illustrated embodiment, in order to change the sewing locus, the upper plates 12 and 13 must be moved horizontally. In this case, when the upper plates are in their ascent position, the lower plate 11 can maintain pressure on the workpiece while the upper plates can change their horizontal position. Accordingly, the fabric clamping portions 23 and 24 are spaced away from the workpiece during horizontal movements of the upper plates 12 and 13. Consequently, displacement of the workpiece is avoided. Upon completion of the horizontal movement to the new sewing locus, the upper plates 12 and 13 can be moved to their descent positions, so that the workpiece fabrics can be pressed by the fabric clamping portions 23 and 24 as well as by the lower plate 11.

Figure 8:
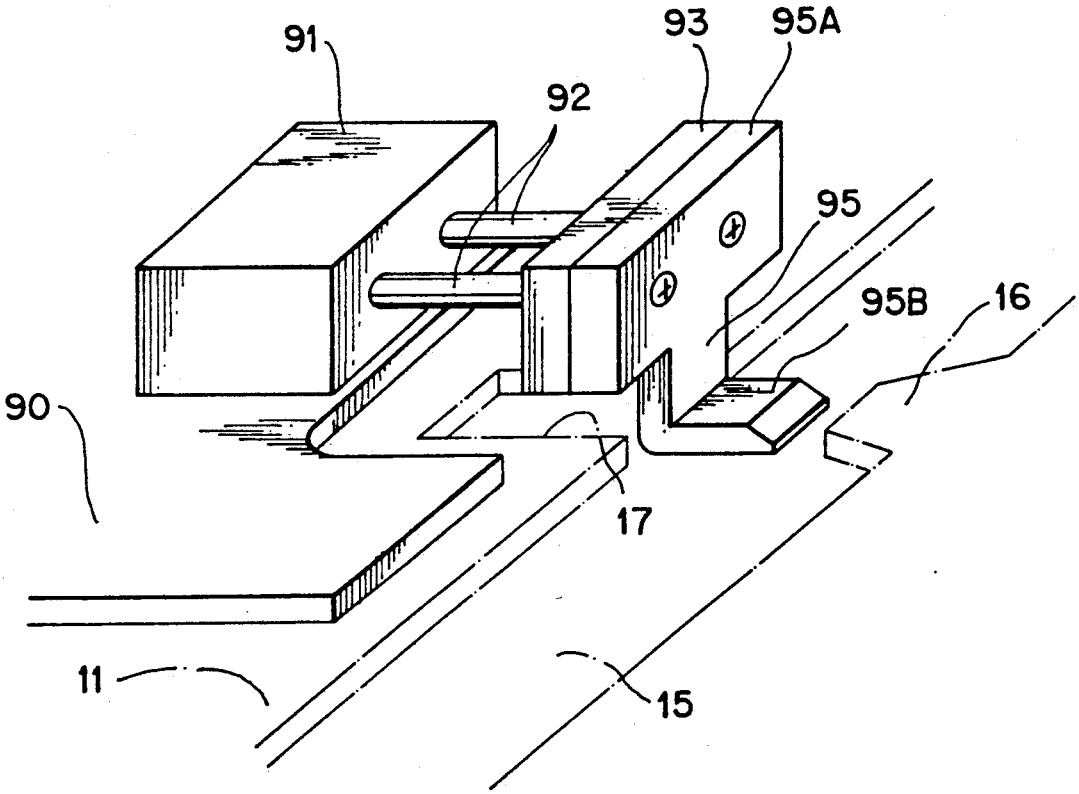
FIG. 8 is a perspective view showing an auxiliary pressure plate.

Next, the auxiliary pressure plate 95 and the driving means therefor will be described with reference to FIGS. 1 and 8. An auxiliary pressure plate 95 is adapted for selectively pressing the workpiece fabric at a position adjacent to the needle location if a relatively large gap is provided between the upper plates 12 and 13, in order to define a particular sewing locus. The auxiliary pressure plate 95 is movably provided above the lower plate 11, and has an operative position where the auxiliary pressure plate is moved into the U-shaped opening 15 when the upper plates 12 and 13 are horizontally moved away from each other, so that the lower surface of the auxiliary pressure plate 95 is flush with the lower surface of the lower plate 11, in order to press a particular portion of the workpiece fabric at a position close to the needle location. The auxiliary pressure plate 95 has a non-operative position to allow abutting horizontal motion of the two upper plates, such that the auxiliary pressure plate 95 does not restrain horizontal motions of the two upper plates 12 and 13. If a large gap is provided between the upper plates 12 and 13, the auxiliary pressure plate 95 presses the workpiece fabric at a position close to the needle location. Accordingly, any workpiece jumping or corrugation during thin workpiece sewing is avoided.

The means for driving the auxiliary pressure plate 95 includes a twin rod type pneumatic cylinder 91 mounted on an upper surface of the central linking plate 90. FIG. 8 particularly shows the twin rod type pneumatic cylinder 91 and the auxiliary pressure plate 95. In FIG. 8, the upper plates 12 and 13 are not delineated. The twin rod type pneumatic cylinder 91 has two cylinder rods 92 extending in parallel with each other, and the cylinder rods 92 are extended or retracted in a horizontal plane. The tip ends of the two cylinder rods 92 are coupled to a plate 93 to which the auxiliary pressure plate 95 is threadedly fixed.

The auxiliary pressure plate 95 includes an attachment portion 95A fixed to the plate 93, and a fabric pressing portion 95B extending downwardly from the attachment portion 95A and provided with a forward bend. The fabric pressing portion 95B is fitted in the notched portion 17 (FIG. 3) of the U-shaped opening 15 of the lower plate 11, and is horizontally movable toward and away from the extension portion 16 of the lower plate 11 in accordance with the extension and retraction of the twin cylinder rods 92. That is, the pressing portion 95B has an operative position in which the portion 95B is positioned in the vicinity of the extension portion 16, and has an non-operative position in which the portion 95B is moved along the notched portion away from the extension portion 16. Further, the lower surface of the pressing portion 95B can become flush with the lower surface of the lower plate 11, when the central linking plate 90 is in its descent position.

Overall operations of the workpiece fabric holding device according to the illustrated embodiment of the present invention will be described next. The pocket cloth 2 is subjected to sewing first along the outer sewing locus 3. For sewing along the outer sewing locus 3, as shown in FIG. 1, the upper pneumatic cylinders 42 and 44 perform retract movements, whereas the lower pneumatic cylinders 41 and 43 perform advancing movements (Here, the term "upper" and "lower" imply the upper and lower portions of the pocket cloth 2). By such movements, the left and right upper plates 12 and 13 are moved away from each other, in the directions indicated by the arrows A and B. As a result, as shown in FIG. 5(*a*), the fabric clamping portions 23 and 24 of the upper plates are positioned adjacent to the outer edgeline of the U-shaped opening 15 of the lower plate 11. In this case, the abutting portions 33 and 34 are also spaced away from each other to provide a discontinuous needle slit at the center portion thereof.

Then, the cylinder rods 92 of the twin rod type pneumatic cylinder 91 are extended, so that the auxiliary pressure plate 95 is positioned near to the extension portion 16 of the lower plate 11. Therefore, fabric portions adjacent to the sewing locus along the L-shaped slits 21 and 22 are pressed by the clamping portions 23 and 24, and further, the discontinuous or spaced portion is pressed by the auxiliary pressure plate 95.

Thereafter, the cylinder rods 78 of the five pneumatic cylinders 71 through 75 are extended downwardly to lower the linking plates 80, 80', 80", 90, so that the upper plates 12 and 13 assume their descent positions in which the upper plates 12 and 13 are brought into intimate contact with the lower plate 11. In this state, the lower surface of the lower plate 11, the bottom surfaces of the fabric clamping portions 23, 24 of the upper plates 12 and 13, and the bottom surface of the auxiliary pressure plate 95 become flush with one another, and the outer sewing locus 3 is provided by the L-shaped slits 21, 22 and by a gap G defined between the auxiliary pressure plate 95 and the extension portion 16. Of course, the gap G is aligned with the L-shaped slits 21 and 22.

As shown in FIG. 5(*a*), the edge portions of the pocket cloth 2 have already been folded by a pocket folder (not shown), and the thus folded pocket cloth 2 is positioned on the garment 1 are held. These pocket cloth 2 and the garment 1 on the sewing machine table 102 by the lower plate 11. Here, it should be noted that the outer sewing locus 3 is provided during non contacting state of the upper plates 12, 13 relative to the workpieces while only the lower plate 11 presses the workpieces so as to avoid disadvantageous displacement of the workpiece.

After the upper plates 12 and 13 and the auxiliary pressure plate 95 are moved to provide the outer sewing locus 3, these components are moved downwardly onto the workpiece. The lower plate 11 presses a major portion of the workpiece, i.e., the pocket cloth 2 and the garment 1, and upon completion of the downward movements of the upper plates 12 and 13, the fabric clamping portions 23 and 24 of the upper plates 12 and 13 press the edge portions of the pocket cloth 2.

Then, the entire workpiece fabric holding device 10 is horizontally moved while maintaining pressure on the workpiece, so that the workpieces 1 and 2 are slidingly moved on the sewing machine table 102 to the sewing machine 101. Next, the sewing machine 101 and the workpiece fabric holding device 10 are both moved, so that the workpieces 1 and 2 are moved relatively to the needle location in order to start sewing operation along the outer sewing locus 3.

When the sewing along the outer sewing locus 3 is completed, when the sewing needle reaches the upper edge locus 5 or 5' (see FIG. 9), the upper plates 12 and 13 must be horizontally moved to change the sewing locus to the inner locus 4. For this change in the sewing locus, firstly, the five pneumatic cylinders 71 through 75 perform retract motions, so that the linking plates 80, 80', 80" and 90 are moved upwardly, to move the upper plates 12 and 13 upwardly. Simultaneously, the auxiliary pressure plate 95 is also moved upwardly. Consequently, the fabric clamping portions 23, 24 of the upper plates 12 and 13 and the auxiliary pressure plate 95 are moved away from the workpieces 1 and 2, while the lower plate 11 maintains pressure contact therewith.

Then, the twin rod type pneumatic cylinder 91 is actuated to retract its cylinder rods 92 so as to retract the auxiliary pressure plate 95 into the notched portion 17 of the lower plate 11. Thereafter, as shown in FIG. 2, the upper pneumatic cylinders 42 and 44 perform advancing motions, whereas the lower pneumatic cylinders 41 and 43 perform retracted motions, so that the upper plates 12 and 13 are moved toward each other in the directions A and B. As a result, as shown in FIG. 5(*b*), the fabric clamping portions 23 and 24 are moved to positions adjacent to the inner edgeline of the U-shaped opening 15 of the lower plate 11. Again, the five pneumatic cylinders 71 through 75 perform downward extending motions, so that the linking plates 80, 80', 80" and 90 are moved downwardly so as to allow the upper plates 12 and 13 to be brought into intimate contact with the lower plate 11.

In this state, the abutting portions 33 and 34 of the upper plates 12 and 13 abut with each other, so that the L-shaped slits 21 and 22 become contiguous with each other, in order to provide the inner sewing locus 4 as shown in FIG. 2. The auxiliary pressure plate 95 is retracted into the notched portion 17, and therefore, the plate 95 does not obstruct the joining of the slits 21 and 22. In other words, the auxiliary pressure plate 95 is not used when defining the inner sewing locus 4. Further, the bottom surfaces of the fabric clamping portions 23 and 24 are flush with the bottom surface of the lower plate 11, and the fabric clamping portions 23 and 24 are, in comparison to the case where the outer sewing locus is provided, located to press a slightly inward portion of the pocket cloth 2. Both the inner and outer sides of the inner sewing locus 4 are pressed by fabric clamping portions 23 and 24. With this state, the workpiece fabric holding device 10 and the sewing machine 101 are moved, so that the workpieces 1 and 2 are moved relatively to the needle location, to start sewing along the inner sewing locus 4.

Incidentally, in the above illustrated embodiment, corner portions 21A and 22A of the L-shaped slits 21 and 22 have widths larger than that in their liner portions. This is due to the fact that since a radius of the outer sewing locus 3 is different from the radius of the inner sewing locus 4, both the inner and outer corner portions of the loci 3 and 4 are still within the corner portions 21A and 22A of the slits. Further, in the above embodiment, the upper end portions of the L-shaped slits 21 and 22 have rhombic shapes 21B and 22B. This is due to the fact that when the sewing needle runs the critical area between the outer and inner sewing loci 3 and 4, at positions corresponding to the areas 5 and 5' (FIG. 9), the upper plates 12 and 13 should be set movable in horizontal direction even if the sewing needle is stopped at any point of in the areas 5 or 5'. Moreover, in the present embodiment, a plurality of pneumatic cylinders 71 through 75 are used for vertically moving the upper plates 12 and 13. This is due to the fact that uniform pressing force is required to be applied to the entire area of the fabric clamping portions 23 and 24.

In the above embodiment, the workpiece fabric holding device 10 works to hold the workpieces for sewing a two-corner type pocket cloth 2 to the garment 1. However, the present invention is not limited to this type of embodiment. For example, in the above described embodiment, two upper plates 12 and 13 are horizontally moved relative to the lower plate 11 in order to perform two array sewings extending in parallel with each other. However, during horizontal movements of the upper plates 12 and 13, rotational motions can be imparted to the upper plates so as to obtain two array sewings each extending in a non-parallel direction to with each other. For the rotational motions of the upper plates 12 and 13, the thickness of the stop collars 53 and 54 is adjustable, and the strokes of the pneumatic cylinders 41 through 44 are controlled.

Further, in the above described embodiment, two upper plates 12 and 13 are used. However, at least two upper plates can be provided so as to perform and/or change sewings along intricate sewing loci, and any cloths other than the pocket cloth are available as workpiece components.

Furthermore, in the above embodiment, the upper plates 12 and 13 are horizontally movable as well as vertically movable. To this effect, the joint plates 63 are used, which are pivotable in a vertical direction in order to connect the second and third bifurcated joints. However, instead of the joint plate 63, leaf springs are also available, since the moving distance of the upper plates in the vertical direction is small. That is, the upper plates 12 and 13 are vertically movably supported to the link mechanism 50 by way of the leaf springs which urge the plates downwardly, and the upper plates 12 and 13 are lifted by the pneumatic cylinders 71 through 75 against the biasing force of the leaf springs.

Moreover, in the above described embodiment, the auxiliary pressure plate 95 is fixed to the rods 92 of the twin rod type pneumatic cylinder 91, so as to linearly move the plate 95 between its operative position and non-operative position. However, the auxiliary pressure plate 95 can be pivotally supported to the central linking plate 90 so as to change its position between the operative and non-operative positions by the swinging motion of the plate 95.

As described above, the workpiece fabric holding device 10, according to the above described embodiment, would provide the following advantages and technical effects.

In the present embodiment, two upper plates 12 and 13 formed with slits 21, 22 (needle running slits) are movably arranged in order to provide a new sewing locus different from the previous sewing locus, and the locus is provided by connecting together the two slits 21 and 22. Therefore, contrary to the conventional device, wherein the movable plates are moved to control the distance therebetween in order to change the sewing locus, the fabric clamping portions 23 and 24 positioned at both edge sides of the slits 21 and 22 can press the workpiece fabric at immediately right and left positions to the needle location, when sewing the workpieces along the inner sewing locus 4 as well as along the outer sewing locus 3. Accordingly, any jumping or corrugation of the workpiece caused by reciprocal penetrations of the sewing needle are obviated, since the workpiece undergoes sufficient clamping or holding by the fabric clamping portions 23 and 24 at the positions close to the running needle. Therefore, even if thin workpieces are is subjected to sewing, no skip stitches nor thread breakage occur, and desirable two array sewings along the loci 3 and 4 can be performed.

Further, when sewing along the outer sewing locus 3, a space or discontinuity is created between the slits 21 and 22. However, the space is occupied by the auxiliary pressure plate 95, and a continuous sewing locus 3 is provided between the pressure plate 95 and the extension portion 16 of the lower plate 11. The spaced portion is pressed by the auxiliary pressure plate 95, and therefore, the sewing portion adjacent to the spaced portion is also held by the plate 95, to avoid any jumping or corrugation of the workpiece as well as avoid skip stitches and thread breakage. On the other hand, if no space or discontinuity is created with respect to the sewing locus, for example, when sewing along the inner sewing locus 4, the auxiliary pressure plate 95 is retracted to the non-operative position, so that the plurality of upper plates can be brought into abutment with each other without mechanical interference from the auxiliary pressure plate 95.

Furthermore, when changing the sewing locus, the upper plates 12 and 13 are moved horizontally. In this case, prior to the horizontal motions of the upper plates, the upper plates and the auxiliary pressure plate 95 are provisionally moved upwardly to move away from the workpieces 1 and 2, while the lower plate 11 continuously holds the workpieces. Then, the upper plates are moved horizontally to change the sewing locus. In the present invention, the upper places are not moved in the horizontal direction while maintaining intimate contact with the workpiece, otherwise the workpiece, particularly edge-folded pocket cloth, may be displaced relative to the garment in accordance with the horizontal motions of the upper plates. Consequently, in the present invention, relative displacement of the workpiece is avoided during horizontal movements of the upper plates 12 and 13, and the major parts of the workpiece are continuously held by the lower plate 11, so that displacement of the workpiece relative to the sewing machine table 102 is also avoided.

While the invention has been described in detail and with reference to specific embodiment thereof, it would be apparent to those skilled in the art that various changes and modifications may be made therein without departing from the spirit and scope of the invention.

What is claimed is:

1. A workpiece fabric holding device for holding a workpiece on a machine table and relatively moving the workpiece to a needle location while continuously holding the workpiece, comprising:

a lower plate movably supported for passing the workpiece, and formed with an opening through which sewing portions including at least two sewing loci are exposed, the lower plate having a lower surface in contact with the workpiece;

at least two upper plates movably supported in a horizontal direction on the lower plate, the upper plates provided with fabric clamping portions extending into the opening and having lower surfaces, needle slits formed at the fabric clamping portions to allow a sewing needle to pass threrethrough, the needle slits having a configuration corresponding to the sewing loci, and the lower surfaces of the fabric clamping portions flush with the lower surface of the lower plate when the fabric clamping portions clamp the workpiece; and horizontal motion driving means for moving the upper plates to first and second positions in the horizontal direction, one of the sewing loci defined by a combination of the needle slits when the upper plates are moved to the first horizontal position and another sewing locus defined when the upper plates are moved to the second horizontal position.

2. The workpiece fabric holding device as claimed in claim 1, wherein the horizontal motion driving means comprises:

first and second pneumatic cylinders mounted on the lower plate for horizontally moving one of the upper plates;

third and fourth pneumatic cylinders mounted on the lower plate for horizontally moving the other upper plate; and link mechanisms connecting the first through fourth pneumatic cylinders and the associated upper plates.

3. The workpiece fabric holding device as claimed in claim 1, wherein the upper plates are movable in a vertical direction as well as in the horizontal direction for providing ascent positions and descent positions, the lower surfaces of the fabric clamping portions being flush with the lower surface of the lower plate when the upper plates are in the descent positions, the workpiece being held by the lower plate and the fabric clamping portions at positions adjacent the needle location.

4. The workpiece fabric holding device as claimed in claim 3, further comprising a vertical motion driving means for moving the upper plates in the vertical direction, the vertical motion driving means being supported on the lower plate and connected to the upper plates, the horizontal motion driving means being driven during a state when the upper plates are in the ascent position spaced away from the workpiece.

5. The workpiece fabric holding device as claimed in claim 4, wherein the vertical motion driving means comprises:

a first vertically oriented pneumatic cylinder mounted on the lower plate;

a first linking plate connected to the first vertically oriented pneumatic cylinder and to one upper plate;

a second vertically oriented pneumatic cylinder mounted on the lower plate;

a second linking plate connected to the second vertically oriented pneumatic cylinder and to the other upper plate;

a third vertically oriented pneumatic cylinder mounted on the lower plate;

a third linking plate connected to the third vertically oriented pneumatic cylinder and to both upper plates;

fourth and fifth vertically oriented pneumatic cylinders mounted on a central portion of the lower plate; and a central linking plate connected to the fourth and fifth vertically oriented pneumatic cylinders and to both upper plates.

6. The workpiece fabric holding device as claimed in claim 1, further comprising an auxiliary pressure plate movably positioned above the lower plate, the auxiliary pressure plate having an operative position extendable into the opening and a non-operative position retracted therefrom, and means for moving the auxiliary pressure plate between the operative and non-operative positions, the auxiliary pressure plate providing pressure on a part of the workpiece at its operative position to ensure that the entire workpiece is held to the machine table.

7. The workpiece fabric holding device as claimed in claim 5, further comprising an auxiliary pressure plate movably positioned above the lower plate, the auxiliary pressure plate having an operative position extendable into the opening and a non-operative position retracted therefrom, and means for moving the auxiliary pressure plate between the operative and non-operative positions, the auxiliary pressure plate providing pressure on a part of the workpiece when in its operative position to ensure that the entire workpiece is held to the machine table, the means for moving the auxiliary pressure plate being mounted on the central linking plate.

8. The workpiece fabric holding device as claimed in claim 7, wherein one sewing locus is defined by connecting together the two needle slits when the auxiliary pressure plate has its non-operative position, and the other sewing locus is defined by the two needle slits and the auxiliary pressure plate positioned between confronting portions of the two needle slits when the auxiliary pressure plate has its operative position.

9. A workpiece fabric holding device for holding a workpiece and relatively moving the workpiece to a needle location while continually holding the workpiece on a machine table, comprising;

a lower plate movably supported for pressing the workpiece, and formed with an opening through which sewing portions including at least two sewing loci are exposed, the lower plate having a lower surface in contact with the workpiece;

at least two upper plates supported movably in a horizontal direction on the lower plate, the upper plates provided with fabric clamping portions extendable into the opening and having lower surfaces, needle slits formed at the fabric clamping portions for allowing a sewing needle to pass therethrough, the needle slits having a configuration corresponding to the sewing loci, the lower surfaces of the fabric clamping portions flush with the lower surface of the lower plate when the fabric clamping portions clamp the workpiece, the upper plates movable in a vertical direction as well as in the horizontal direction to provide ascent positions and descent positions, the lower surfaces of the fabric clamping portions flush with the lower surface of the lower plate when the upper plates are in the descent positions, the workpiece being held by the lower plate and the fabric clamping portions at positions adjacent the needle location;

horizontal motion driving means for moving the upper plates to first and second positions in the horizontal direction, one of the sewing loci defined by the combination of the needle slits when the upper plates are moved to the first horizontal positions and another sewing locus defined when the upper plates are moved to the second horizontal positions;

a vertical motion driving means for moving the upper plates in a vertical direction, the vertical motion driving means supported on the lower plate and connected to the upper plates, the horizontal motion driving means driven during a state when the upper plates are in the ascent position spaced away from the workpiece;

an auxiliary pressure plate movably positioned above the lower plate, the auxiliary pressure plate having an operable portion extendable into the opening and a non-operative position retracted therefrom, and means for moving the auxiliary pressure plate between the operative and non-operative positions, the auxiliary pressure plate providing pressure on a part of the workpiece when in its operative position, to ensure that the entire workpiece is held against the machine table.

* * * * *